United States Patent [19]

Shelton

[11] Patent Number: 4,714,070

[45] Date of Patent: Dec. 22, 1987

[54] GUARD FOR PROTECTING A COMPOUND BOX

[76] Inventor: Ronnie J. Shelton, 1826 E. Line, Sapulpa, Okla. 74066

[21] Appl. No.: 889,475

[22] Filed: Jul. 25, 1986

[51] Int. Cl.[4] ..... F41B 5/00

[52] U.S. Cl. ..... 124/86

[58] Field of Search ..... 124/1, 23 R, 24 R, 80, 124/86; 182/108, 109; 150/52 G

[56] References Cited

U.S. PATENT DOCUMENTS

| | | | |
|---|---|---|---|
| 1,600,103 | 9/1926 | Evans | 182/108 |
| 2,925,877 | 2/1960 | Wright | 182/108 |
| 2,968,300 | 1/1961 | Allen | 124/23 R |
| 2,992,696 | 7/1961 | Jedinak | 182/108 |
| 4,331,311 | 5/1982 | Russell | 124/23 R |

*Primary Examiner*—Anton O. Oechsle
*Assistant Examiner*—Benjamin Layno

[57] ABSTRACT

A guard for attachment to the split limb end portions of a compound bow is disclosed. The guard includes at least one body attachable to a lateral edge of a split limb end portions of the compound bow and extends a greater distance from the compound bow than a pulley used on the compound bow. The guard is used to prevent the pulley and/or the split limb end portions of the compound bow from being damaged, and is used to prevent the compound bow from sliding and falling when placed in an upright position against a horizontal surface, such as the ground.

9 Claims, 4 Drawing Figures

GUARD FOR PROTECTING A COMPOUND BOX

BACKGROUND OF THE INVENTION

1. Field of the Invention

The present invention relates to a guard for attachment to one end of a compound bow and, more particularly, a compound bow having split limb end portions, such that a pulley mounted between the split limb end portions is protected from being damaged when the compound bow is placed against a surface.

2. Description of the Prior Art

A compound bow is a recent invention whereby using a pair of pulleys on each end of a bow body and a unique stringing arrangement an archer can aim while holding a far lesser force than the force used to drive the arrow to its target. Usually, these compound bows include split limb and portions and a notch on each limb end and include a double pulley mounted transversely within the notch. The pulley is mounted adjacent the extreme outer end of the notch so that the pulley extends out from the split limb end portions of the compound bow.

When an archer is hunting, it is common for the archer to rest the compound bow on the ground in a vertical position or lean it against an object. The problem with this is that the split limb end portions of the compound bow can become damaged or marred. However, the greatest problem is that the pulley can be bent or become clogged with dirt and other material. Further, there is a problem of a compound bow not standing upright because when resting on the ground, the pulley doesn't provide sufficient ground adhesion so the compound bow slides and falls.

There is a need for a simple, inexpensive guard that can be attached to the split limb end portions of a compound bow to prevent damage to the compound bow and its pulley, as well as a guard to provide ground adhesion to aid in preventing the compound bow from sliding and falling when it is placed in a vertical position.

SUMMARY OF THE INVENTION

The present invention has been designed to meet the above described needs and overcome the foregoing disadvantages. The present invention comprises at least one body for attachment to a split limb end portion of a compound bow to prevent damage thereto. The body includes a back surface and at least one end surface with a cavity extending into the body from the back surface for receiving a lateral edge surface of a split limb end portion of the compound bow. The end surface, when the body is attached to the compound bow, extends a greater distance from the split limb end portion then the pulley mounted within a notch between the split limb end portions.

The body can be used alone or with a mirror-image body on each of the split limb end portions of the compound bow to guard the pulley from being damaged when the compound bow is laid vertically. Further, the body can include ground adhesion bars to aid in preventing the compound bow from slipping and falling when laid vertically.

DETAILED DESCRIPTION OF THE PREFERRED EMBODIMENTS

Figure 1:
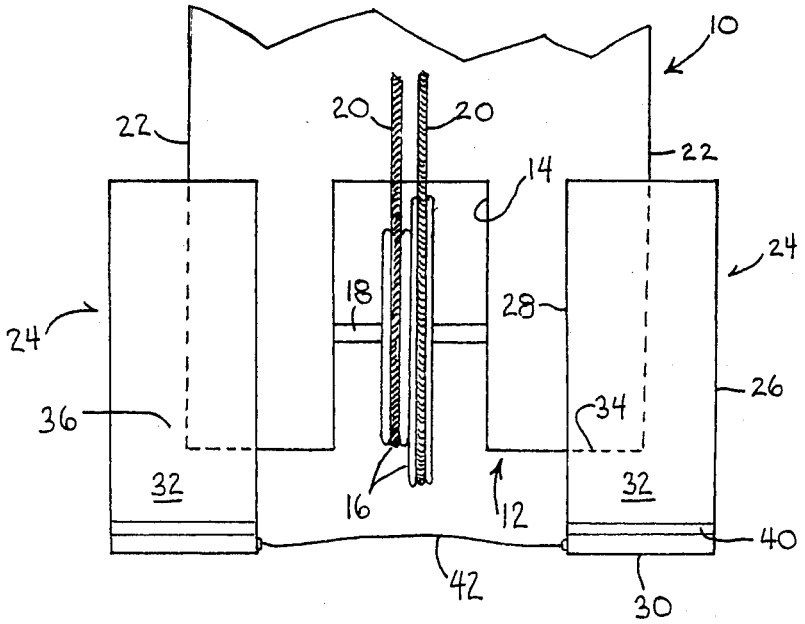
FIG. 1 is a front elevational view of a lower limb end of a compound bow including a pair of guards, embodying the present invention, mounted on the side edges of the split limb end portions thereof.

The present invention comprises a guard for attachment to a compound bow to prevent damate to the lower limb end thereof. As shown in FIG. 1, a compound bow 10 includes split limb end portions 12 with a notch 14 formed therein. At least one and usually two separate or mated pulleys 16 are mounted transversely within the notch 14 by way of a shaft or axle 18. Bow strings 20 are mounted around the pulleys 16 and thus to the compound bow 10, as is well known to those skilled in the art. As can be seen in FIG. 1, the lower edge of at least one pulley 16 extends a greater distance than the split limb end portions 12, i.e., the pulley 16 is unprotected and can be easily damaged.

Figure 3:
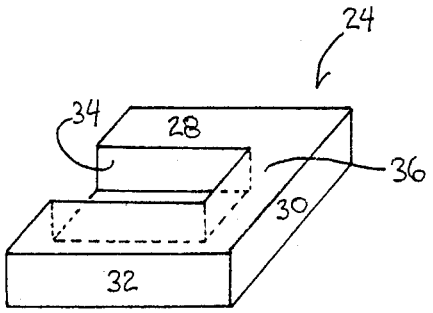
FIG. 3 is a perspective view of the back surface of one embodiment of the present invention.

Mounted to at least one lateral edge 22, and preferably to both opposed lateral edges 22, is a guard 24 that includes a front surface 26, a back surface 28, an end surface 30, and side surfaces 32. The back surface 28 of the guard 24 includes a cavity 34 which is sized and shaped to receive therein the lateral edge 22 of the compound bow 10. Specifically, the cavity 34 does not extend fully across the back surface 28 because the remaining portion of the back surface 28, indicated by reference numeral 36, prevents the guard 24 from sliding fully onto the compound bow 10. This is because the end surface 30 should extend a greater distance than the greatest distance of the pulley 16 to provide protection thereto. Because the lateral surface edges 22 of the compound bow 10 are at 90° angles to the front and back surfaces of the body of the compound bow, the cavity 34 will usually be rectangular in cross-section, as shown in FIG. 3. If the compound bow 10 includes dogears or upstarts on the lower longitudinal end thereof, then the cavity 34 can be closed ended. However, usually the compound bow 10 will not include such dogears or upstarts, so the cavity 34 will have an open split limb portion forming a U-shape to facilitate the mounting of the guard 24 onto the compound bow 10, as will be described later.

Figure 2A:
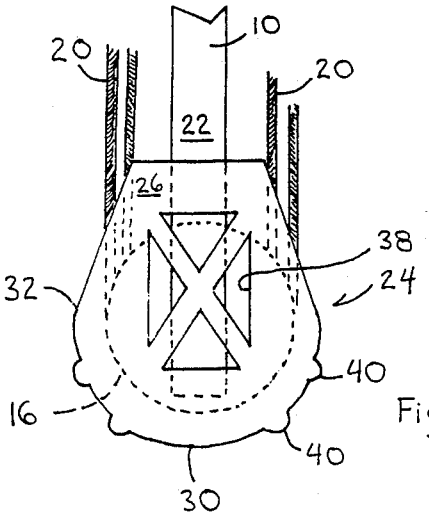
FIG. 2A is a side elevational view of a guard, embodying the present invention, mounted on a side edge of a split end portion of a compound bow.
Figure 2B:
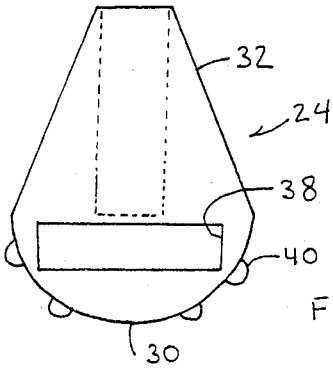
FIG. 2B is a side elevational view of an alternate embodiment of the guard shown in FIG. 2A.

When viewed from the side, as in FIG. 2, the guard 24 can be teardrop shaped (as shown), rectangular (as shown in FIG. 3), square, circular, or any other shape desired. For reduction in weight and excess material costs, the teardrop shape is preferable. To further reduce weight, the front surface 26 of the guard 24 can include an opening 38 which can extend into communication with the cavity 34. The opening 38 can be square, circular, triangular, or the like, and the guard can include a plurality of openings 38. As shown in FIG. 2A, the openings 38 are arranged into an X-pattern that provides the necessary structural integrity, as well as the desired reduction in weight. In FIG. 2B, the opening 38 is spaced from the cavity 34.

As shown in FIGS. 1 and 2, the side and end surfaces (32, 30) of the guard 24 include at least one ground adhesion member 40, which can be one or more upstarts or a transverse bar, as shown. The ground adhesion member 40 aids in preventing the compound bow 10 from sliding and falling when laid vertically. The ground adhesion member 40 may not be necessary depending upon the shape of the guard and the material it is made from. For example, if the guard 24 is rectangular in cross-section (as shown in FIG. 3) the outer angled ends can act as ground adhesion members 40.

The guard 24 can be formed from almost any available material, such as wood, plastic, ceramic material, rubber, sponge or metal. For ease of manufacture, being light weight, and for providing the desired nondamaging constitution and ground adhesion, injected molded or vacuum molded synthetic rubber is preferable. Further, while only one guard 24 can be used and two are preferable, a flexible connection 42 can be attached or formed into two guards 24, as shown in FIG. 1, to hold the two guards 24 together and prevent their loss. The connection 42 can be a length of string, a rod, or an extension of the material used in forming the guards 24. It should be noted that the connection 42 is formed in such a shape that the two guards 24 are really one unit that slips over the end of the compound bow 10 to protect all surfaces thereof, such a in the form of a glove or hood.

The guard 24 is mounted to the lateral surface 22 of the compound bow 10 by simple adhesion or gripping provided by the close fitting dimensions of the cavity 34 or by the inherent tackiness of the material used to form the guard 24, such as evidenced by some synthetic rubbers. Further, the inner surface or surfaces of the cavity 34 can be provided with adhesion media, such as glue, double-sided tape, or Velcro with mating members on the edge 22 of the compound bow 10. For ease of mounting and appearance, tape can be used to surround an upper end portion of the guard 24, extend into the notch 14 above the pulley's axle 18 and around the longitudinal end of the compound bow 10. The tape can be simple adhesive tape or Velcro, as desired.

Wherein the present invention has been described in particular relation to the drawings attached hereto, it should be understood that other and further modifications, apart from those shown or suggested herein, can be made within the scope and spirit of the present invention.

What is claimed is:

1. A guard for attachment to a compound bow provided with a pair of limbs each having a pair of split limb end portions and a notch having a pulley transversely mounted therein, the split limb end portions each having a lateral edge surface and one end surface, said guard comprising:

a pair of bodies each including a back surface and at least one end surface, the back surface including a cavity therein adapted to receive the lateral edge surface and the end surface of a split limb end portion of the compound bow, when one of said bodies is attached to each split limb end portion of a bow limb, the bodies extend a greater distance along the longitudinal axis of the bow limb from the split limb ends than the pulley, whereupon, when the compound bow is resting in an upright position on a horizontal surface upon the guard, the pulley is suspended from the surface protecting it from damage.

2. The guard of claim 1 wherein each cavity is rectangular in cross-section.

3. The guard of claim 1 wherein each cavity includes means for adhering the body to the compound bow.

4. The guard of claim 1 wherein each body is substantially rectangular in cross-section.

5. The guard of claim 1 wherein each body is substantially teardrop shaped in cross-section.

6. The guard of claim 1 wherein each cavity is U-shaped with a closed end thereof adjacent the at least one end surface.

7. The guard of claim 1 and including at least one ground adhesion member on the at least one end surface.

8. The guard of claim 1 and including at least one opening in the front surface extending into the cavity.

9. The guard of claim 1 and including flexible means for connecting the bodies together.

* * * * *